US007293606B2

(12) United States Patent
Benoit et al.

(10) Patent No.: US 7,293,606 B2
(45) Date of Patent: Nov. 13, 2007

(54) HEAT EXCHANGING APPARATUS

(75) Inventors: Maurice Rene Benoit, Chauvin (CA); Denis Benoit, Chauvin (CA)

(73) Assignee: 391854 Alberta Limited (CA)

( * ) Notice: Subject to any disclaimer, the term of this patent is extended or adjusted under 35 U.S.C. 154(b) by 307 days.

(21) Appl. No.: 11/076,183

(22) Filed: Mar. 9, 2005

(65) Prior Publication Data

US 2006/0201668 A1 Sep. 14, 2006

(51) Int. Cl.
*E21B 36/00* (2006.01)
*F28F 1/32* (2006.01)

(52) U.S. Cl. ..... 166/57; 166/61; 237/70; 237/71; 165/171

(58) Field of Classification Search ..... 166/57, 166/61; 237/70, 71; 165/171
See application file for complete search history.

(56) References Cited

U.S. PATENT DOCUMENTS

| | | | | |
|---|---|---|---|---|
| 3,497,000 | A | 2/1970 | Hujsak et al. | |
| 3,911,896 | A * | 10/1975 | Charboneau et al. | 122/21 |
| 4,090,476 | A * | 5/1978 | Rybar et al. | 122/367.4 |
| 5,037,293 | A | 8/1991 | Kirby | |
| RE35,696 | E * | 12/1997 | Mikus | 166/303 |
| 5,862,858 | A * | 1/1999 | Wellington et al. | 166/59 |
| 5,899,269 | A * | 5/1999 | Wellington et al. | 166/58 |
| 6,019,172 | A * | 2/2000 | Wellington et al. | 166/58 |
| 6,269,882 | B1 * | 8/2001 | Wellington et al. | 166/303 |
| 6,776,227 | B2 | 8/2004 | Beida et al. | |
| 2005/0082064 | A1 * | 4/2005 | Foster et al. | 166/303 |

FOREIGN PATENT DOCUMENTS

| | | |
|---|---|---|
| CA | 2015638 | 11/1995 |
| CA | 2375565 | 9/2003 |
| CA | 2413182 | 9/2003 |

OTHER PUBLICATIONS

Firm brochure entitled "Innovative Industrial Heating," CCI Thermal Technologies Inc., 12 pp., undated.
Firm brochure entitled "Cata-Dyne TM Heater," CCI Thermal Technologies Inc., 6 pp., dated Jul. 2, 2003.
Firm brochure entitled "Gas Catalytic Explosion-Proof Heaters," CCI Thermal Technologies Inc., 14 pp., undated.

* cited by examiner

*Primary Examiner*—William Neuder
*Assistant Examiner*—Nicole Coy
(74) *Attorney, Agent, or Firm*—Rodman & Rodman; Terrence N. Kuharchuk

(57) ABSTRACT

A heat exchanging apparatus including a gas fuelled flameless heater and a heat exchanger loop. The heat exchanger loop includes a heat absorbing section which is contained within the flameless heater so that the flameless heater provides a heat source for the heat exchanger loop, and the heat exchanger loop further includes a heat transferring section for transferring heat from the heat exchanger loop to a heat sink.

26 Claims, 6 Drawing Sheets

HEAT EXCHANGING APPARATUS

TECHNICAL FIELD

A heat exchanging apparatus including a gas fuelled flameless heater as a heat source.

BACKGROUND OF THE INVENTION

Gas fuelled flameless heaters rely on a flameless combustion or oxidation of a gaseous hydrocarbon fuel in order to produce heat. The hydrocarbon fuel is typically natural gas or propane. The oxidation reaction involves an exothermic reaction between the hydrocarbon fuel and oxygen, typically in the presence of a catalyst, to produce water vapor, carbon dioxide and infrared energy (i.e. heat).

A typical flameless heater includes a housing which typically contains a catalyst pad. The catalyst pad is typically located adjacent to the front of the housing. The catalyst pad includes a catalyst which is carried on a substrate to provide a catalyst bed which serves as the site of the oxidation reaction. The housing also typically contains an electrical heating element which is used to preheat the catalyst pad during start-up of the flameless heater.

The hydrocarbon fuel is delivered to the back of the flameless heater, where it is distributed so that the fuel is dispersed throughout the catalyst pad. The front of the flameless heater is covered with a screen but is otherwise open to the heater environment so that ambient air can contact the catalyst pad in order to supply the catalyst pad with the oxygen needed to react with the hydrocarbon fuel. Insulation in the form of one or more ceramic fiber pads is typically provided behind the catalyst pad so that the heat produced by the oxidation reaction is directed toward the front of the heater. The water vapor and carbon dioxide which are produced by the oxidation reaction exit the heater from the front of the catalyst pad and are typically eliminated from the heater environment with some form of venting which removes these reaction products to a location outside of the heater environment.

Flameless heaters provide several advantages in heating applications. First, the absence of a flame enables flameless heaters to be used in hazardous locations where flammable materials are handled, processed, used or stored. Second, the absence of carbon monoxide as a reaction product of the oxidation reaction enables flameless heaters to be used in indoor locations as long as proper ventilation is provided.

As a result of these advantages, flameless heaters are frequently used in oil and gas installations, which are often classified as Class I hazardous locations. For example, flameless heaters are often used to heat structures at oil and gas installations, which structures may be used to house equipment associated with wellheads, pipelines, batteries etc.

One characteristic of flameless heaters is that they produce low intensity infrared heat which is absorbed by objects within the range of the heater. The closer an object is to the heater, the more heat the object will absorb.

As a result of this characteristic, some attempts have been made to employ a flameless heater at oil and gas installations as a heat source for heating equipment which is located outside of the structure which houses the heater.

U.S. Pat. No. 6,776,227 (Beida et al) describes an apparatus and method for heating and preventing freeze-off of wellhead equipment. The apparatus includes a heat exchanger having an interior reservoir, a filler opening, a fluid outlet and a fluid inlet. The heat exchanger is preferably a finned radiator in the nature of an automotive radiator. The apparatus further includes a conduit loop running from the fluid outlet to the fluid inlet and a pump for circulating a fluid through the heat exchanger and the conduit loop. The conduit loop includes a supply section for supplying heat to wellhead equipment from heated fluid and a return section for returning cooled fluid to the heat exchanger.

The heat exchanger is positioned sufficiently close to a heat-radiating element of a flameless heater such as a gas catalytic heater such that the fluid within the interior reservoir of the heat exchanger may be heated by radiant heat from the flameless heater. The heat exchanger may be mounted onto the flameless heater with brackets or in some embodiments, the heat exchanger may be sandwiched between a pair of flameless heaters.

U.S. Pat. No. 6,776,227 (Beida et al) further describes a gas supply system for use with a heating apparatus including a heat exchanger, a gas heater and a gas-driven pump for circulating fluid from the heat exchanger, which gas supply system includes a primary gas line for delivering pressurized gas from a main gas supply for driving the pump, a secondary gas line for carrying exhaust gas from the pump to the gas heater to fuel the heater, a back-up fuel gas supply line in communication with the secondary gas line, a valve mounted in the back-up fuel gas supply line, and a valve-actuating means for opening and closing the valve. The gas supply system enables a single source of gas both to drive the gas-driven pump and fuel the gas heater.

The invention described in U.S. Pat. No. 6,776,227 (Beida et al) relies upon positioning the heat exchanger sufficiently close to the flameless heater so that radiant heat from the flameless heater provides heat to the heat exchanger. The use of radiant heat results in the apparatus being relatively inefficient, with the degree of inefficiency being directly proportional to the distance between the heat exchanger and the flameless heater.

There remains a need for a heat exchanging apparatus which utilizes a flameless heater as a heat source for a heat exchanger loop, but which is relatively more efficient than the apparatus described in U.S. Pat. No. 6,776,227 (Beida et al).

SUMMARY OF THE INVENTION

The present invention is a heat exchanging apparatus in which a heat absorbing section of a heat exchanger loop is contained within a gas fuelled flameless heater. Placing the heat absorbing section of the heat exchanger loop within the flameless heater minimizes the extent to which heat transfer must rely upon radiation instead of conduction and/or convection.

In one particular aspect, the invention is a heat exchanging apparatus comprising:

(a) a gas fuelled flameless heater comprising a housing; and (b) a heat exchanger loop, wherein the heat exchanger loop comprises a heat absorbing section, wherein the heat absorbing section is contained within the housing so that the flameless heater provides a heat source for the heat exchanger loop.

The flameless heater may be comprised of any gas fuelled flameless heater in which an exothermic oxidation reaction generating heat occurs within the heater between oxygen and a gaseous hydrocarbon fuel.

The flameless heater is preferably comprised of a housing. The housing may constructed of any suitable material. The housing may be comprised of a front end and a back end.

The back end of the housing is preferably defined by a back wall. The housing is preferably substantially open at the front end. The housing preferably comprises a side wall which extends between the front end and the back end of the housing. In preferred embodiments the flameless heater is substantially rectangular in shape so that the housing and the side wall are substantially rectangular. The flameless heater, the housing and the side wall may, however, have any shape.

The flameless heater preferably is further comprised of a catalyst pad contained within the housing. The catalyst pad may be comprised of a single unitary pad or structure or may be comprised of a plurality of pads or structures which together make up the catalyst pad. For example, the catalyst pad may be comprised of a plurality of stacked sheets or planar layers. The catalyst pad is preferably positioned adjacent to the front end of the housing. The oxidation reaction preferably occurs within or proximate to the catalyst pad.

The flameless heater may be further comprised of other components, including an electrical heating element adjacent to the catalyst pad for preheating the catalyst pad during start-up of the flameless heater, a regulator for regulating the pressure of a gas fuel which is delivered to the flameless heater, a distributor for distributing the gas fuel within the flameless heater, a screen at the front end of the housing to contain the catalyst pad within the housing while allowing water vapor and carbon dioxide products of the oxidation reaction to exit the heater at the front end of the housing, and insulation positioned within the housing between the catalyst pad and the back end of the housing for directing heat produced by the oxidation reaction toward the front end of the housing. The insulation is preferably comprised of one or more sheets or planar layers of an insulating material such as a ceramic fiber pad.

The heat exchanger loop may be comprised of any structure or apparatus in which a heat exchanger fluid may be circulated. The heat exchanger loop is preferably comprised of a conduit. The heat exchanger loop may be comprised of a continuous uninterrupted conduit or may be comprised of structures or apparatus, such as pumps, reservoirs, valves, meters, heat exchangers or other structures or apparatus which are connected together with lengths of the conduit or in some other manner.

The heat exchanger loop is preferably further comprised of a heat absorbing section and a heat transferring section. The heat absorbing section functions to absorb heat from the flameless heater as a heat source. The heat transferring section functions to transfer heat from the heat exchanger loop to a heat sink. The heat sink may be comprised of any structure, device, apparatus or area which is sought to be heated by the heat exchanging apparatus. In preferred embodiments, the heat sink may be associated with an oil and gas installation and may, for example, comprise a wellhead component or a hydrocarbon storage tank.

The heat exchanger fluid preferably circulates through the heat exchanger loop in a circulating direction. The heat exchanger loop may be further comprised of a supply section extending between the heat absorbing section and the heat transferring section so that heat can be supplied from the heat absorbing section to the heat transferring section as the heat exchanger fluid passes through the heat exchanger loop in the circulating direction from the heat absorbing section to the heat transferring section. The heat exchanger loop may also be further comprised of a return section extending between the heat transferring section and the heat absorbing section so that the heat exchanger fluid can be returned to the heat absorbing section for reheating as it passes through the heat exchanger loop in the circulating direction from the heat transferring section to the heat absorbing section.

The heat absorbing section of the heat exchanger loop provides an environment in which the heat exchanger fluid contained within the heat exchanger loop may be heated by the flameless heater without relying exclusively on radiant heat transfer. As a result, the heat absorbing section is contained within the Blameless heater. The heat absorbing section of the heat exchanger loop may therefore be comprised of any structure, device or apparatus which is effective to absorb heat from the flameless heater and which can be positioned within the flameless heater. For example, the heat absorbing section may be comprised of a conduit or may be comprised of a tank or reservoir for the heat exchanger fluid.

The heat absorbing section is preferably constructed to facilitate relatively efficient heat transfer. For example, the heat absorbing section is preferably constructed of a material which is relatively heat conductive and is preferably shaped and configured to maximize the transfer of heat from the heat absorbing section to the heat exchanger fluid.

The heat absorbing section may include fins or other structures to enhance the absorption of heat by the heat absorbing section. Preferably the heat absorbing section provides an environment in which a relatively large amount of the heat exchanger fluid may be contained within the flameless heater at any given time, in order to maximize the heat transfer efficiency. As a result, preferably the heat absorbing section is comprised of a heat exchanger fluid reservoir or is comprised of an extended length of conduit which serpentines within the flameless heater. In preferred embodiments the heat absorbing section is comprised of an extended length of a conduit which serpentines within the flameless heater.

Preferably the heat absorbing section is contained within the housing of the flameless heater. Preferably the heat absorbing section is contained within the housing such that the heat absorbing section contacts the catalyst pad. More preferably the heat absorbing section is contained within the housing such that the heat absorbing section is substantially surrounded by the catalyst pad. For example, where the catalyst pad is comprised of a plurality of layers, the heat absorbing section may be contained between two layers of the catalyst pad.

The heat transferring section of the heat exchanger loop provides an environment in which the heat exchanger fluid contained within the heat exchanger loop may transfer heat to the heat sink. The heat transferring section of the heat exchanger loop may therefore be comprised of any structure, device or apparatus which is effective to transfer heat from the heat exchanger loop to the heat sink.

Preferably the heat transferring section provides an environment in which a relatively large amount of the heat exchanger fluid is contained within the heat transferring section at any given time, in order to maximize the heat transfer efficiency.

For example, the heat transferring section may be comprised of a conduit which preferably contacts the heat sink so that heat may be transferred to the heat sink by conduction. The conduit may extend along or wrap around a heat sink such as a pipe or other object, or the conduit may extend within a heat sink such as a hydrocarbon storage tank. Preferably the conduit is coiled or serpentines so that the conduit has an extended length, in order to maximize the heat transfer from the conduit to the heat sink. Alternatively, the heat transferring section may be comprised of a tank or reservoir for containing the heat exchanger fluid and the heat sink may be placed within the tank or reservoir.

The heat transferring section is preferably constructed to facilitate relatively efficient heat transfer. For example, the heat transferring section is preferably constructed of a material which is relatively heat conductive and is preferably shaped and configured to maximize the transfer of heat from the heat transferring section to the heat sink.

The flameless heater may be further comprised of a heater gas inlet for providing a fuel to the flameless heater. The beat exchanging apparatus may be further comprised of a controller for controlling an amount of the fuel which is supplied to the flameless heater via the heater gas inlet. The controller is preferably operatively connected with a temperature sensor so that the amount of the fuel which is supplied to the flameless heater via the heater gas inlet is dependent upon a sensed temperature.

The sensed temperature may be any temperature or combination of temperatures upon which the operation of the controller is to be dependent. For example, the flameless heater may be located within a heater environment and the sensed temperature may be comprised of an ambient heater environment temperature. Alternatively, the sensed temperature may be a temperature within the heat exchanger loop so that the sensed temperature is comprised of a heat exchanger loop temperature. The heat exchanger loop temperature may relate to a temperature at any location within the heat exchanger loop, but preferably is a temperature within the supply section of the heat exchanger loop. In some preferred embodiments, the sensed temperature is comprised of both the ambient heater environment temperature and the heat exchanger loop temperature within the supply section and one of the temperatures is designated as an override sensed temperature. Preferably the heat exchanger loop temperature is the override sensed temperature so that the operation of the controller will be primarily dependent upon the heat exchanger loop temperature.

The heat exchanger loop may be further comprised of a pump for circulating the heat exchanger fluid through the heat exchanger loop. The pump may be connected within the heat exchanger loop at any location. Preferably the pump is located within the return section of the heat exchanger loop.

The pump may be driven in any manner. For example, the pump may be driven by a motor which is powered by gasoline, diesel, electricity, solar energy, or in some other manner. In some preferred embodiments, the pump is a gas driven pump. In particular, in some preferred embodiments the pump is driven by a pressurized hydrocarbon gas, such as propane or natural gas, which is suitable for use as a fuel by the flameless heater.

The source of the hydrocarbon gas may be any source or combination of sources, including but not limited to a wellhead, a pipeline and/or a storage tank. The hydrocarbon gas may be pressurized at the source or the hydrocarbon gas may become pressurized between the source and the pump. Preferably the hydrocarbon gas is pressurized at the source to avoid the need for a separate gas compressor.

For example, pressurized hydrocarbon gas from a wellhead may be delivered to the pump. If the pressure of the hydrocarbon gas at the wellhead is greater than the pressure required by the pump, a regulator may be provided between the wellhead and the pump so that a pressure regulated supply of hydrocarbon gas is delivered to the pump.

In such embodiments, the pump may be comprised of a pump exhaust outlet for exhausting the hydrocarbon gas from the pump as exhausted hydrocarbon gas and the pump exhaust outlet may be in communication with the heater gas inlet of the flameless heater so that the fuel for the flameless heater is comprised of the exhausted hydrocarbon gas from the pump. If the pressure of the exhausted hydrocarbon gas is greater than the pressure required at the heater gas inlet, a regulator may be provided between the pump exhaust inlet and the heater gas inlet so that a pressure regulated supply of exhausted hydrocarbon gas is delivered to the heater gas inlet. If the pressure of the exhausted hydrocarbon gas is less than the pressure required at the heater gas inlet, a compressor may be provided between the pump exhaust inlet and the heater gas inlet in order to pressurize the exhausted hydrocarbon gas to the required pressure.

Furthermore, in such embodiments, the apparatus may be further comprised of the controller since a flowrate of hydrocarbon gas which is exhausted from the pump may not necessarily be equal to the amount of fuel which is required at the pump gas inlet. As a result, in such embodiments the apparatus may be further comprised of a gas storage vessel interposed between the pump exhaust outlet and the controller, for storing the exhausted hydrocarbon gas if the flowrate of the exhausted hydrocarbon gas exceeds the amount of fuel required at the pump gas inlet. The gas storage vessel is closed in order to contain the exhausted hydrocarbon gas and may be provided with a pressure relief valve in order to maintain a desired pressure of the exhausted hydrocarbon gas in the gas storage vessel.

In order to address the possibility that the flowrate of the exhausted hydrocarbon gas may be less than the amount of fuel required to be delivered to the pump gas inlet, or the possibility that the pump may fail, the apparatus may be further comprised of a back-up fuel supply for the flameless heater, which back-up fuel supply may be controlled with the controller or in some other manner.

The heat exchanging apparatus may be further comprised of a reservoir for storing an amount of the heat exchanger fluid, to account for losses within the apparatus or expansion and contraction of the heat exchanger fluid within the heat exchanger loop. The reservoir may be located anywhere within the heat exchanger loop, but preferably is located within the return section of the heat exchanger loop so that the heat exchanger fluid is not provided with an opportunity to lose heat before it reaches the heat transferring section. The reservoir may be closed or open, but preferably is vented to the atmosphere to avoid excessive pressurization of the heat exchanger loop.

BRIEF DESCRIPTION OF DRAWINGS

Embodiments of the invention will now be described with reference to the accompanying drawings, in which.

DETAILED DESCRIPTION

The present invention is a heat exchanging apparatus comprising a gas fuelled flameless heater and a heat exchanger loop in which a heat absorbing section of the heat exchanger loop is contained within the flameless heater.

Figure 2:
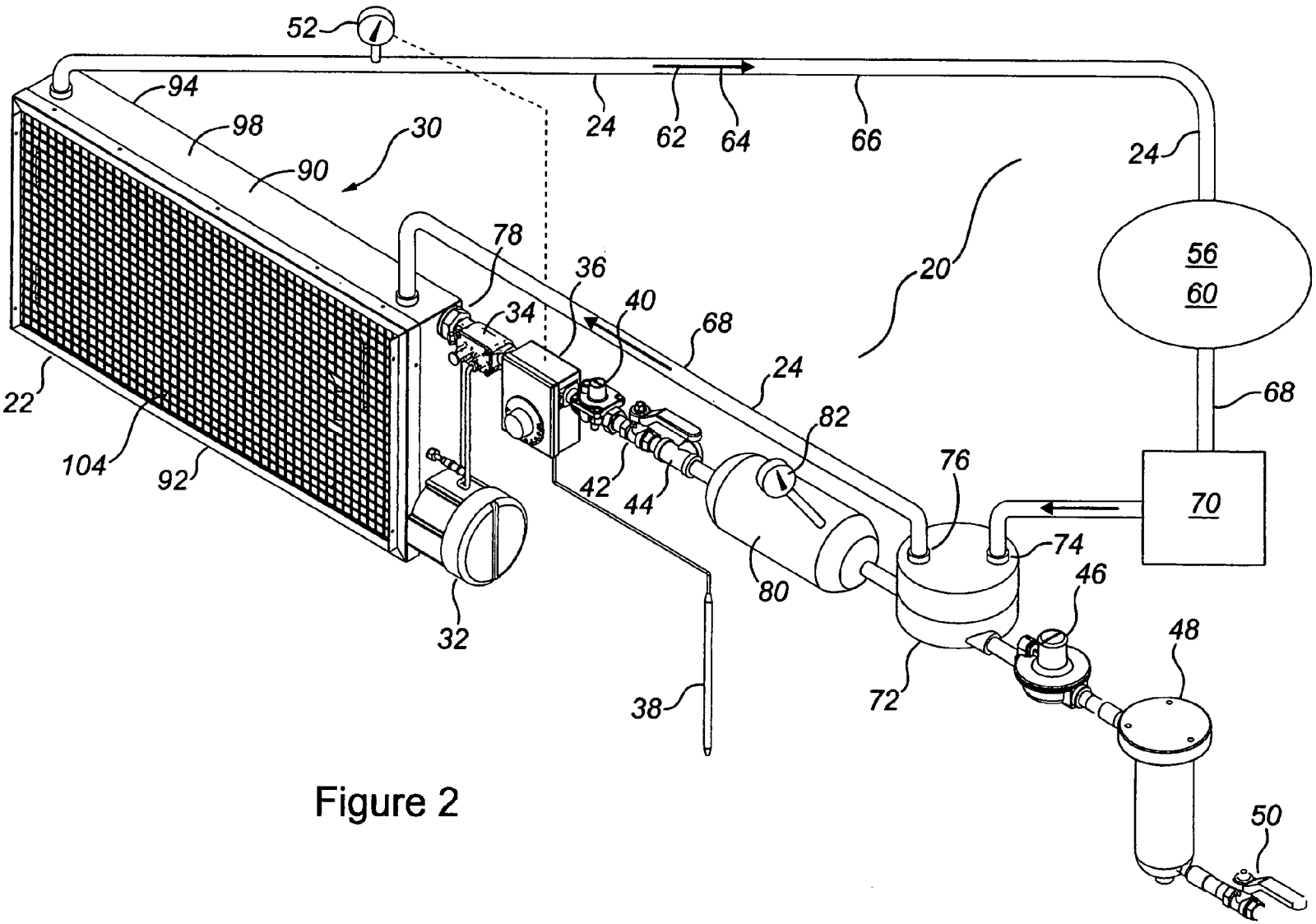
FIG. 2 is a schematic pictorial view of a heat exchanging apparatus according to a preferred embodiment of the invention, including a flameless heater and a heat exchanger loop.
Figure 3:
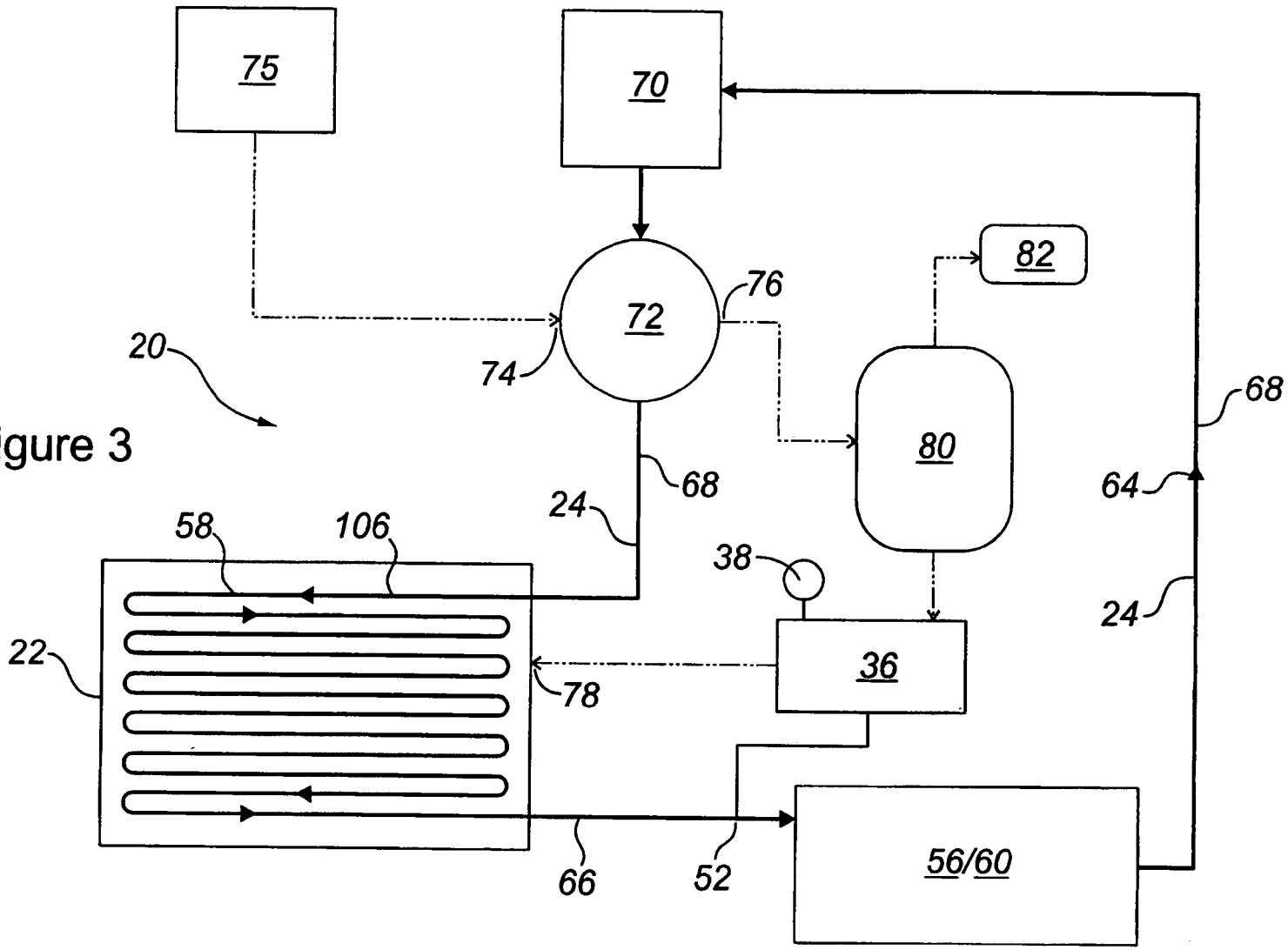
FIG. 3 is a schematic view of a heat exchanging apparatus according to a preferred embodiment of the invention.
Figure 4:
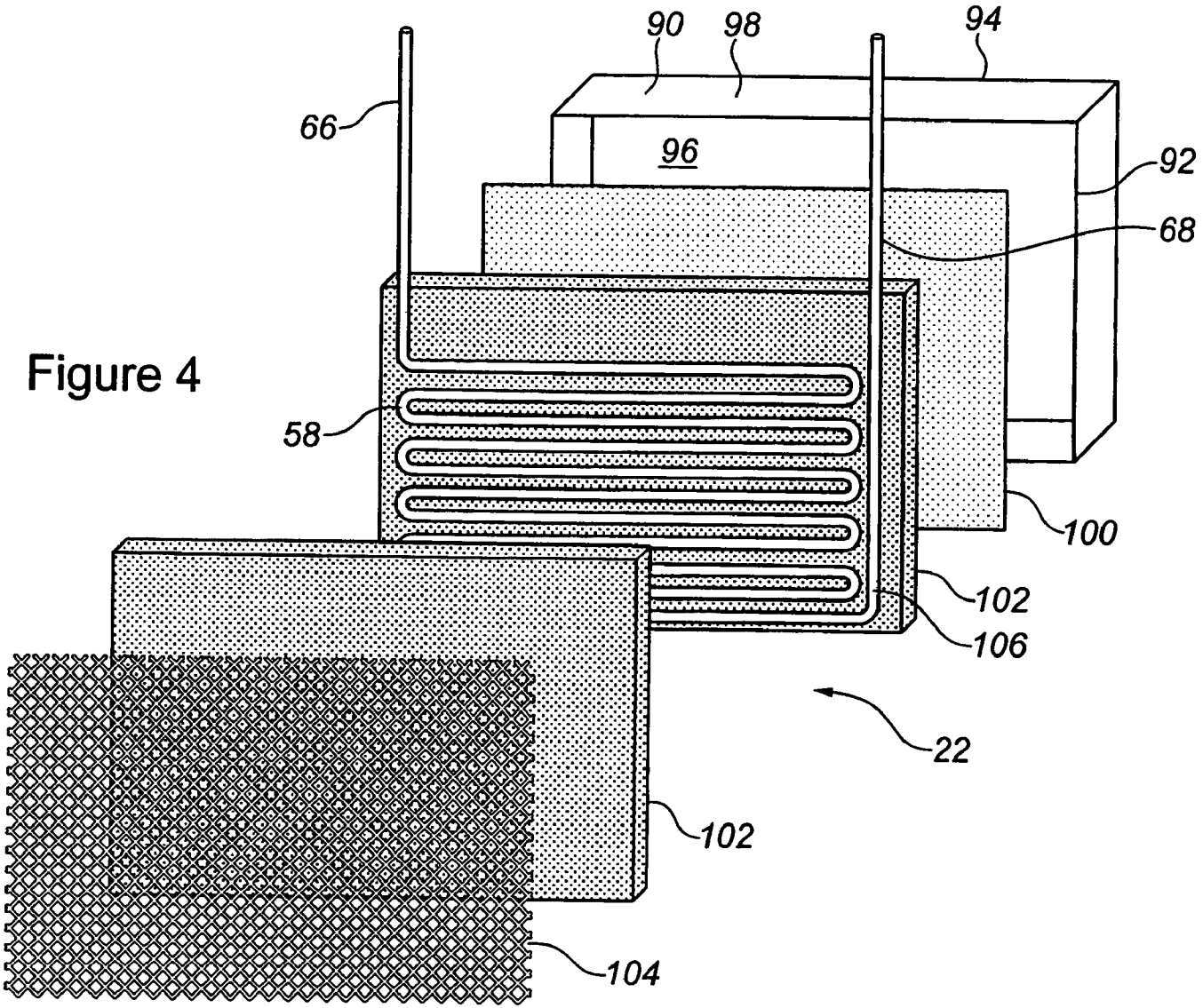
FIG. 4 is an exploded schematic pictorial view of a flameless heater which includes a heat absorbing section of a heat exchanger loop contained therein.

Referring to FIGS. 2-4, a heat exchanging apparatus (20) according to a preferred embodiment of the invention includes a gas fuelled flameless heater (22) and a heat exchanger loop (24).

The flameless heater (22) may be comprised of any gas fuelled flameless heater. Preferably the flameless heater (22) is comprised of a gas catalytic heater. In the preferred embodiment the flameless heater is comprised of a gas catalytic heater such as or similar to a Cata-Dyne™ flameless infrared catalytic gas heater, manufactured by CCI Thermal Technologies Inc. of Edmonton, Alberta, Canada.

Figure 1:
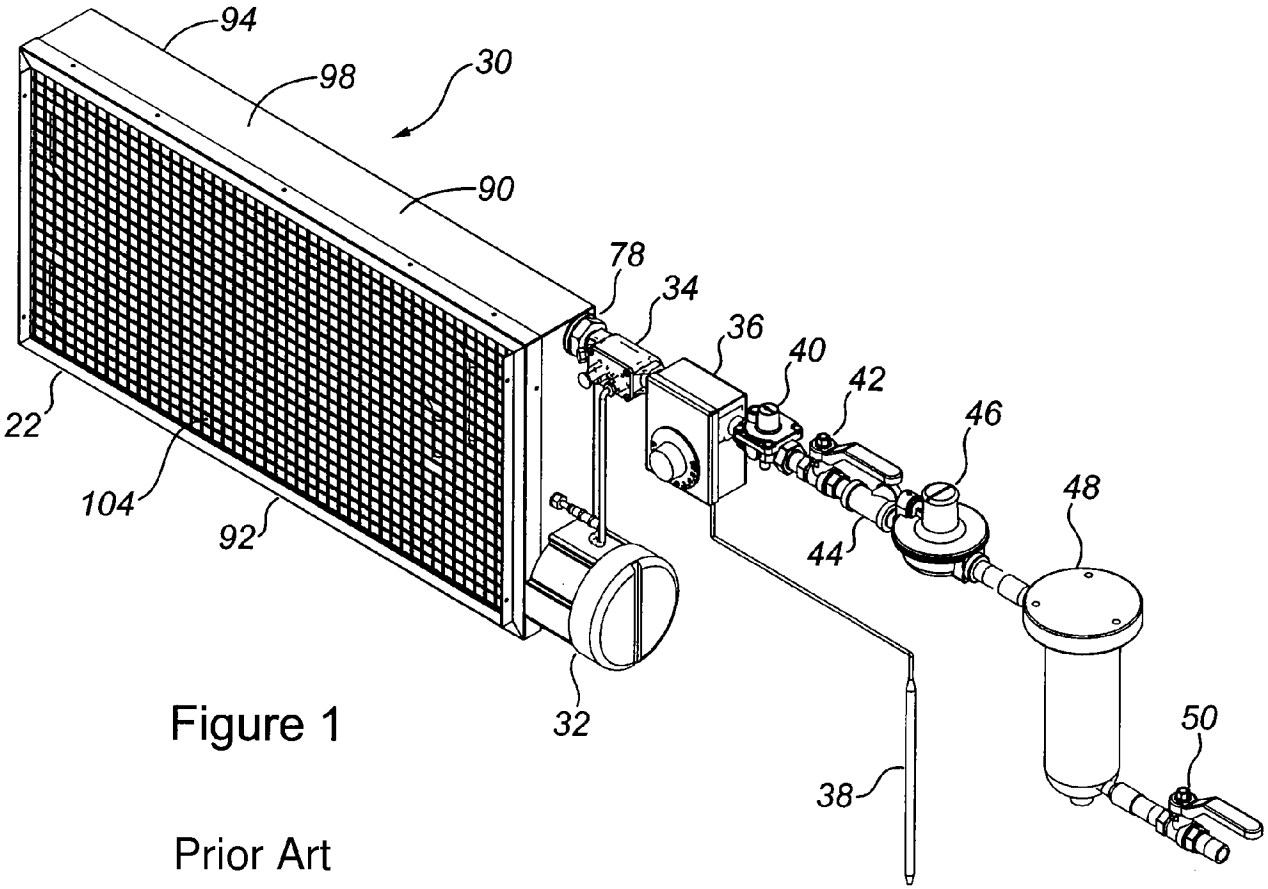
Figure 1 Prior Art
FIG. 1 is a pictorial view of a typical prior art flameless heater of the type which is suitable for use in the invention.

Referring to FIG. 1, there is depicted a typical Cata-Dyne™ gas catalytic heater unit (30) which is suitable to be adapted for use in the invention, comprising the flameless heater (22), a junction box (32) for an electrical heating element (not shown), a safety shut-off valve (34), a controller (36) with an ambient temperature sensor (38) for sensing an ambient heater environment temperature, a heater unit gas regulator (40), a heater unit shut-off valve (42), a tee (44) to facilitate interconnection of heater units, a gas service regulator (46), an inline gas filter (48) and a master shut-off valve (50).

In operation, the typical Cata-Dyne™ gas catalytic heater unit (30) is started using 12 volts DC, 120 volts AC or some other source of electricity which is passed through the junction box (32), causing the electrical heating element to heat the interior of the heater unit (30) to a temperature which facilitates oxidation of the gas fuel which is supplied to the heater unit (30).

Referring to FIG. 2, there is depicted the heat exchanging apparatus (20) according to the preferred embodiment of the invention, comprising the typical Cata-Dyne™ gas catalytic heater unit (30) as adapted for use in the invention, and further comprising the heat exchanger loop (24), a loop temperature sensor (52) for sensing a heat exchanger loop temperature, and a heat sink (56).

Referring to FIGS. 2-3, in the preferred embodiment the heat exchanger loop (24) is comprised of a heat absorbing section (58) and a heat transferring section (60). A heat exchanger fluid (62) is contained within the heat exchanger loop (24) for circulation in a circulating direction (64). The heat exchanger loop (24) is further comprised of a supply section (66) extending between the heat absorbing section (58) and the heat transferring section (60) and is further comprised of a return section (68) extending between the heat transferring section (60) and the heat absorbing section (58).

In the preferred embodiment the heat exchanger loop (24) is further comprised of a reservoir (70) for storing an amount of the heat exchanger fluid, which reservoir (70) is located within the return section (68) of the heat exchanger loop (24). The reservoir (70) is preferably comprised of either an open vessel or a closed vessel which is vented to prevent excessive buildup of pressure in the heat exchanger loop (24).

In the preferred embodiment the heat exchanger loop (24) is further comprised of a pump (72). The pump (72) may be powered by a motor but in the preferred embodiment the pump (72) is a gas driven pump. Preferably the pump (72) is driven by a pressurized hydrocarbon gas which is suitable for use as a fuel in the flameless heater (22), such as for example propane or natural gas.

In the preferred embodiment, the pump (72) is connected between the gas service regulator (46) and the tee (44). The pump (72) is comprised of a pump inlet (74) for intaking pressurized hydrocarbon gas to drive the pump (72). A source (75) of the hydrocarbon gas is connected directly or indirectly to the master shut-off valve (50). The source (75) of the hydrocarbon gas may be any source or combination of sources, including a wellhead, a pipeline and/or a storage tank.

In the preferred embodiment the source (75) of the hydrocarbon gas is a wellhead (not shown), so that the hydrocarbon gas is pressurized at the source (75). Alternatively, the hydrocarbon gas may become pressurized using a compressor (not shown) positioned between the source (75) and the pump (72). The gas service regulator (46) is positioned between the pump inlet (74) and the source (75) so that a pressure regulated supply of hydrocarbon gas is delivered to the pump inlet (74).

The pump (72) is further comprised of a pump exhaust outlet (76) for exhausting the hydrocarbon gas from the pump (72) as an exhausted hydrocarbon gas. The flameless heater (22) is further comprised of a heater gas inlet (78) for providing a fuel to the flameless heater (22). The pump exhaust outlet (76) is in communication with the heater gas inlet (78) so that the fuel for the flameless heater (22) is comprised of the exhausted hydrocarbon gas from the pump (72).

Preferably the pump (72) and the gas service regulator (46) are configured so that the pressure of the exhausted hydrocarbon gas is compatible with the required gas pressure at the heater gas inlet (78). In other words, the pressure of the pressure regulated supply of hydrocarbon gas at the pump inlet (74), the pressure drop experienced by the hydrocarbon gas in the pump (72) and the required gas pressure at the heater gas inlet (78) should preferably be such that the pressure of the exhausted hydrocarbon gas at the pump exhaust outlet (76) is greater than or equal to the required pressure at the heater gas inlet (78). If insufficient gas pressure exists at the pump exhaust outlet (76), the exhausted hydrocarbon gas will require pressurization before arriving at the heater gas inlet (78). If the gas pressure at the pump exhaust outlet (76) is greater than is required at the heater gas inlet (78), the pressure may be regulated by the heater unit gas regulator (40).

Using a pump (72) which is gas driven avoids the need for a motor to be provided at locations where the heat exchanging apparatus (20) is being used, which is advantageous at remote locations where a source of pressurized gas may be available but a motor or fuel for a motor may not be available. Using the exhausted hydrocarbon gas from the pump (72) as a fuel for the flameless heater (22) eliminates venting to the atmosphere of the exhausted hydrocarbon gas which might otherwise be required.

The controller (36) controls the amount of fuel which is received by the flameless heater (22). In the preferred embodiment the controller (36) therefore controls the amount of the exhausted hydrocarbon gas which is supplied to the heater gas inlet (78).

Since the amount of fuel which is required by the flameless heater (22) may not necessarily be equal to the flowrate of the exhausted hydrocarbon gas, a gas storage vessel (80) is interposed between the pump exhaust outlet (76) and the controller (36) in the preferred embodiment. The gas storage vessel (80) functions to store an amount of the exhausted hydrocarbon gas so that fluctuations in the amount of fuel required by the flameless heater (22) may be accommodated by drawing from or adding to the gas storage vessel (80). The gas storage vessel (80) is closed to contain the exhausted hydrocarbon gas and is provided with a pressure relief valve (82) so that a desired pressure of the exhausted hydrocarbon gas can be maintained in the gas storage vessel (80).

The controller (36) may control the amount of the hydrocarbon gas which is supplied to the heater gas inlet (78) in any manner. For example, the controller (36) may supply a constant amount of hydrocarbon gas to the heater gas inlet (78) or may supply a varying amount of hydrocarbon gas to the heater gas inlet (78) according to a programmed schedule. Preferably, however, the amount of the hydrocarbon gas which is supplied to the heater gas inlet (78) is controlled by the controller (36) so that it is dependent upon one or more sensed temperatures.

In the preferred embodiment the amount of the hydrocarbon gas which is supplied to the heater gas inlet (78) is controlled by the controller (36) so that it is dependent upon both an ambient heater environment temperature and a heat exchanger loop temperature as sensed temperatures.

Figure 5:
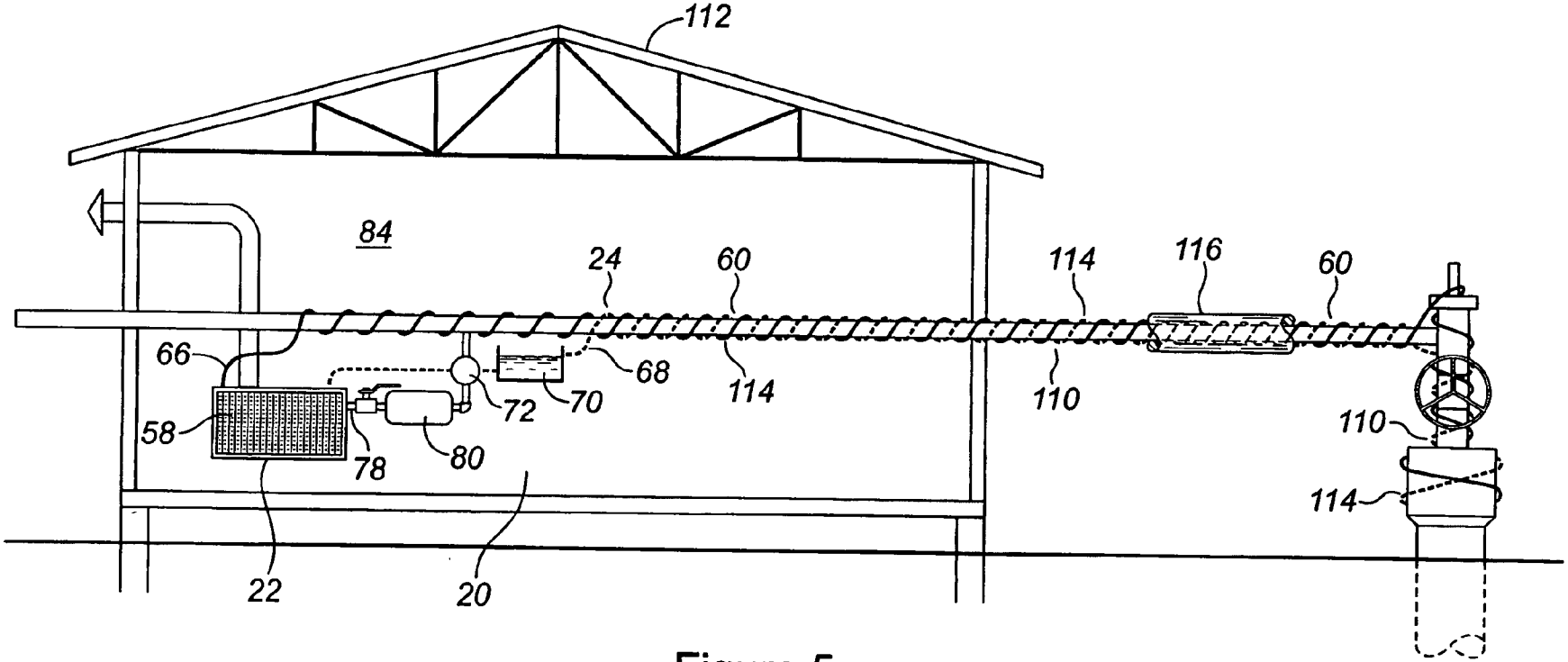
FIG. 5 is a schematic elevation view of a heat exchanging apparatus according to a preferred embodiment of the invention, in which the heat sink is comprised of wellhead components.
Figure 6:
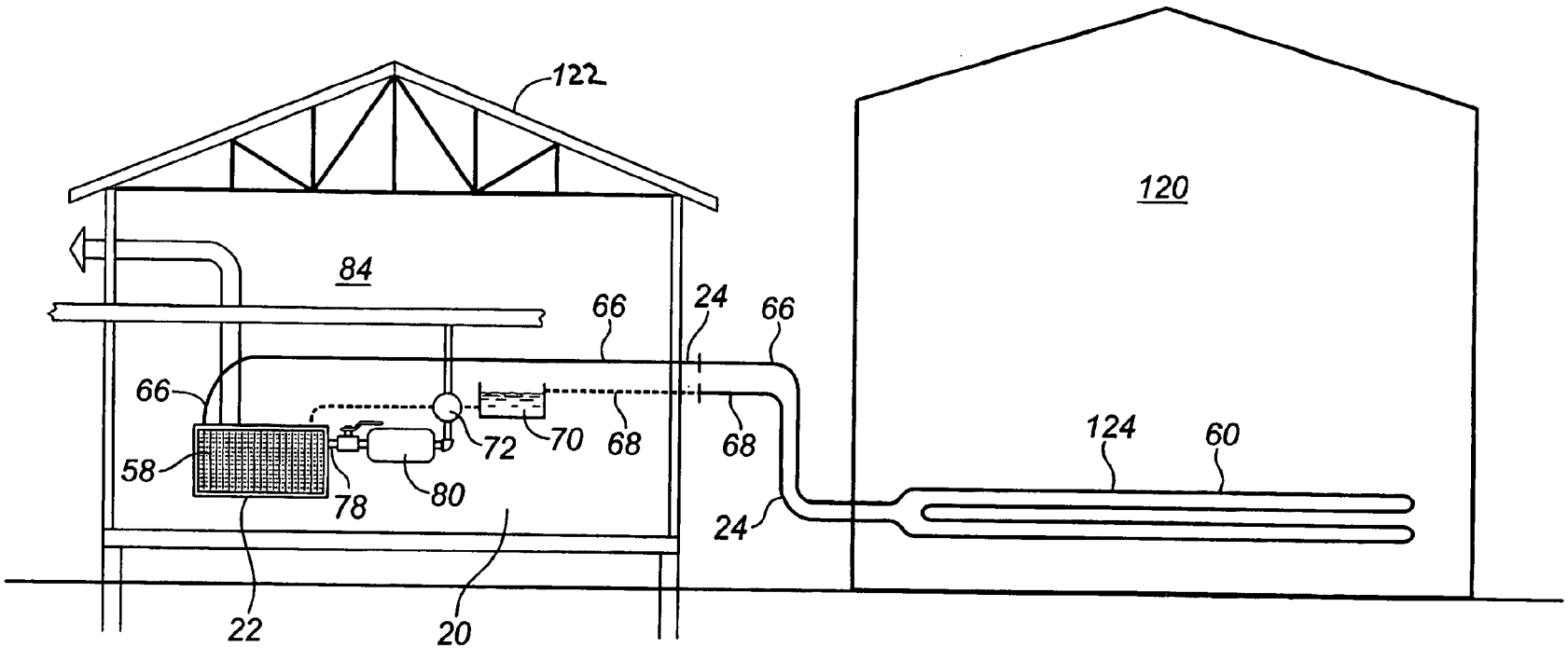
FIG. 6 is a schematic elevation view of a heat exchanging apparatus according to a preferred embodiment of the invention, in which the heat sink is comprised of a hydrocarbon storage tank.

Referring to FIG. 2 and FIGS. 5-6, the flameless heater (22) is located within a heater environment (84), which preferably is an environment which is sought to be heated by the flameless heater (22). For example, in FIGS. 5-6 the heater environment (84) in preferred embodiments of the invention is a building or enclosure within which the flameless heater (22) is located. As a result, in the preferred embodiment the heater environment (84) is a building or enclosure and the ambient heater environment temperature is the temperature within the building or enclosure as sensed by the ambient temperature sensor (38). The ambient heater environment temperature provides an indication of the heating demands and/or status of the heater environment (84).

The heat exchanger loop temperature may be sensed at any location along the heat exchanger loop (24), but preferably the heat exchanger loop temperature is sensed at a location within the supply section (66) of the heat exchanger loop (24). Referring to FIGS. 2-3, in the preferred embodiment the loop temperature sensor (52) is located within the supply section (66) of the heat exchanger loop (24) so that the heat exchanger loop temperature is sensed within the supply section (66). The heat exchanger loop temperature provides an indication of the heating potential of the heat exchanging apparatus (20) with respect to the heat sink (56).

The sensed temperatures may be processed by the controller (36) using any suitable logic, algorithm or combinations of algorithms. In the preferred embodiment the controller (36) is configured so that the heat exchanger loop temperature is an override sensed temperature. In other words, the heating potential of the heat exchanging apparatus (20) with respect to the heat sink (56) takes precedence over the heating demands and/or status of the heater environment (84).

In the preferred embodiment the controller (36) controls the amount of the exhausted hydrocarbon gas which is supplied to the heater gas inlet (78). The heat exchanging apparatus (20) may, however, be further comprised of a back-up fuel supply (not shown) for the flameless heater (22) to address the possibility that the flowrate of the exhausted hydrocarbon gas may be insufficient to supply adequately the flameless heater (22) or the possibility that the pump (72) may fail or be replaced with a motor driven pump, in which case the controller (36) may alternatively or additionally control an amount of a back-up fuel which is supplied to the heater gas inlet (78).

Where provided, the back-up fuel supply may be connected with the tee (44) or at some other location upstream of the controller (36) to facilitate communication between the back-up fuel supply and the controller (36). The back-up fuel supply may include an actuatable valve (not shown) which may be controlled by the controller (36) so that the back-up fuel supply is utilized only when needed.

Referring to FIG. 4, there is depicted components of a preferred embodiment of the flameless heater (22) with the heat absorbing section (58) contained therein. The flameless heater (22) is comprised of a housing (90). The housing (90) is comprised of a front end (92) and a back end (94). The back end (94) of the housing (90) is defined by a back wall (96) and the front end (92) of the housing (90) is substantially open. The housing (90) further comprises a side wall (98) which extends between the front end (92) and the back end (94) of the housing (90).

Contained within the housing (90) are an insulating layer (100) adjacent to the back wall (96), a catalyst pad (102) and a screen (104). The catalyst pad (102) is comprised of a plurality of planar layers. The heat absorbing section (58) preferably contacts the catalyst pad (102) so that the heat transfer from the flameless heater (22) to the heat absorbing section (58) at least in part involves conduction. In the preferred embodiment the heat absorbing section (58) is substantially surrounded by the catalyst pad (102) in order to maximize the efficiency of the heat transfer.

In the preferred embodiment the heat absorbing section (58) is comprised of a heat absorbing conduit (106) which is arranged within the housing (90) so that it serpentines, thus extending the length of the heat absorbing conduit (106) which is contained within the housing (90). Referring to FIG. 2, in the preferred embodiment the heat exchanger loop (24) enters the flameless heater (22) through the side wall (98). The heat absorbing section (58) terminates at the side wall (98) of the housing (90) so that the heat absorbing section (58) is contained entirely within the flameless heater (22).

The heat absorbing conduit (106) is constructed of a material which is relatively heat conductive and the extended length of the heat absorbing conduit (106) within the housing (90) assists in maximizing the exposure of the heat exchanger fluid (62) to the flameless heater (22). The heat absorbing conduit (106) may be cylindrical in cross-section or may be oval shaped or some other shape which will increase the surface area of the heat absorbing conduit (106).

The heat exchanging apparatus (20) of the invention may be used in any applications where a flameless heater (22) may be used and where it is necessary to transfer heat to a heat sink (56). The flameless heater (22) functions to transfer heat to the heat exchanger loop (24), which heat is in turn transferred to the heat sink (56). In preferred embodiments the flameless heater (22) also functions to transfer heat to the heater environment (84). It is, however, not necessary for the practice of the invention that the flameless heater (22) perform the function of heating the heating environment (84).

For example, in some applications, the flameless heater (22) may be isolated and insulated from the heater environment (84) so that a maximum amount of the heat generated by the flameless heater (22) is available to be transferred to the heat exchanger loop (24). In such applications, either it is not necessary for the heater environment (84) to be heated, or the heater environment (84) may be heated in some other manner.

The heat sink (56) may or may not be connected with or associated with the heater environment (84) and the heat sink (56) may be proximate to the heater environment (84) or may be remote from the heater environment (84). Where the heat sink (56) is relatively remote from the heater environment (84), the heat exchanger loop (24) and in particular the supply section (66) of the heat exchanger loop (24), are preferably insulated to minimize the amount of heat which is dissipated from the heat exchanger loop (24) between the heat absorbing section (58) and the heat sink (56).

The heat sink (56) may be comprised of any structure, device, apparatus or area which is sought to be heated by the heat exchanging apparatus (20). For example, the invention may be used in industrial, commercial and residential applications to provide heat to a wide range of different heat sinks (56). As depicted in FIGS. 5-6, the heat sink (56) is associated with an oil and gas installation.

Referring to FIG. 5, there is depicted a preferred embodiment of an application of the invention in which the heat sink (56) is comprised of wellhead components (110) and the heater environment (84) is comprised of a building (112) for housing some of the wellhead components (110).

In the FIG. 5 embodiment, the supply section (66) and the return section (68) of the heat exchanger loop (24) are relatively short in length, while the heat transferring section (60) is relatively long in length.

The heat transferring section (60) in the FIG. 5 embodiment is comprised of a heat tracing conduit (114) which is wrapped around pipes and other equipment comprising the wellhead components (110). The heat tracing conduit (114) is constructed of a material which is relatively heat conductive and the heat tracing conduit (114) may have a cross section which is shaped to increase the surface area of the heat tracing conduit (114). Insulation (116) may be wrapped around the heat tracing conduit (114) and the wellhead components (110) in order to reduce the dissipation of heat from the heat transferring section (60) to the surrounding air.

In the FIG. 5 embodiment, the flameless heater (22) functions both as the heat source for the heat exchanging apparatus (20) and as a heater for the building (112). The heat output of the flameless heater (22) is controlled by the controller (36) having regard to both the ambient heater environment temperature and the heat exchanger loop temperature as sensed temperatures. The heat exchanger loop temperature is an override sensed temperature, with the result that the ambient heater environment temperature may fluctuate within a considerable range, depending upon the heating requirements over time of the heat sink (56).

Referring to FIG. 6, there is depicted a preferred embodiment of an application of the invention in which the heat sink (56) is comprised of a hydrocarbon storage tank (110) and the heater environment (84) is comprised of a building (122) which may or may not be associated with the heat sink (56).

In the FIG. 6 embodiment, the supply section (66) and the return section (68) of the heat exchanger loop (24) are relatively long in length, while the heat transferring section (60) is relatively short in length. The supply section (66) and the return section (68) are preferably insulated (not shown) to reduce heat dissipation from the heat exchanger loop (24) between the heat absorbing section (58) and the heat transferring section (60).

The heat transferring section (60) in the FIG. 6 embodiment is comprised of a heating coil (124) which is located within the hydrocarbon storage tank (120).

The heating coil (124) is constructed of a material which is relatively heat conductive and the heating coil (124) may have a cross section which is shaped to increase the surface area of the heating coil (124). The heating coil (124) serpentines within the hydrocarbon storage tank (120) in order to extend the length of the heat transferring section (60) within the hydrocarbon storage tank (120).

In the FIG. 6 embodiment, the Blameless heater (22) functions both as the heat source for the heat exchanging apparatus (20) and as a heater for the building (122). As in the FIG. 5 embodiment, the heat output of the flameless heater (22) is controlled by the controller (36) having regard to both the ambient heater environment temperature and the heat exchanger loop temperature as sensed temperatures. The heat exchanger loop temperature is an override sensed temperature, with the result that the ambient heater environment temperature may fluctuate within a considerable range, depending upon the heating requirements over time of the heat sink (56).

The embodiments of the invention in which an exclusive property or privilege is claimed are defined as follows:

1. A heat exchanging apparatus comprising:

(a) a gas fuelled flameless heater comprising a housing; and (b) a heat exchanger loop, wherein the heat exchanger loop comprises a heat absorbing section, wherein the heat absorbing section is contained within the flameless heater so that the flameless heater provides a heat source for the heat exchanger loop.

2. The apparatus as claimed in claim 1 wherein the flameless heater is further comprised of a catalyst pad contained within the housing and wherein the heat absorbing section is contained within the housing such that the heat absorbing section contacts the catalyst pad.

3. The apparatus as claimed in claim 2 wherein the heat absorbing section of the heat exchanger loop is contained within the housing such that the heat absorbing section is substantially surrounded by the catalyst pad.

4. The apparatus as claimed in claim 2 wherein the heat exchanger loop is further comprised of a heat transferring section for transferring heat from the heat exchanger loop to a heat sink.

5. The apparatus as claimed in claim 4 wherein the heat exchanger loop is further comprised of a pump for circulating a heat exchanger fluid through the heat exchanger loop.

6. The apparatus as claimed in claim 5 wherein the pump is a gas driven pump.

7. The apparatus as claimed in claim 6 wherein the pump is driven by a pressurized hydrocarbon gas which is suitable for use as a fuel for the flameless heater.

8. The apparatus as claimed in claim 7 wherein the pump is comprised of a pump exhaust outlet for exhausting the hydrocarbon gas from the pump as an exhausted hydrocarbon gas, wherein the flameless heater is further comprised of a heater gas inlet for providing the fuel for the flameless heater, and wherein the pump exhaust outlet is in communication with the heater gas inlet so that the fuel for the flameless heater is comprised of the exhausted hydrocarbon gas.

9. The apparatus as claimed in claim 8, further comprising a controller for controlling an amount of the exhausted hydrocarbon gas which is supplied to the heater gas inlet.

10. The apparatus as claimed in claim 9, further comprising a gas storage vessel interposed between the pump exhaust outlet and the controller, for storing an amount of the exhausted hydrocarbon gas.

11. The apparatus as claimed in claim 9 wherein the controller is operatively connected with a temperature sensor so that the amount of the exhausted hydrocarbon gas which is supplied to the heater gas inlet is dependent upon a sensed temperature.

12. The apparatus as claimed in claim 11 wherein the heat exchanger loop is further comprised of a supply section extending between the heat absorbing section and the heat transferring section and wherein the sensed temperature is comprised of a heat exchanger loop temperature within the supply section.

13. The apparatus as claimed in claim 11 wherein the flameless heater is located within a heater environment and wherein the sensed temperature is comprised of an ambient heater environment temperature.

14. The apparatus as claimed in claim 13 wherein the heat exchanger loop is further comprised of a supply section extending between the heat absorbing section and the heat transferring section and wherein the sensed temperature is further comprised of a heat exchanger loop temperature within the supply section.

15. The apparatus as claimed in claim 14 wherein the controller is configured such that the heat exchanger loop temperature is an override sensed temperature.

16. The apparatus as claimed in claim 5, further comprising a controller for controlling an amount of a fuel which is supplied to the flameless heater.

17. The apparatus as claimed in claim 16 wherein the controller is operatively connected with a temperature sensor so that the amount of the fuel which is supplied to the flameless heater is dependent upon a sensed temperature.

18. The apparatus as claimed in claim 17 wherein the heat exchanger loop is further comprised of a supply section extending between the heat absorbing section and the heat transferring section and wherein the sensed temperature is comprised of a heat exchanger loop temperature within the supply section.

19. The apparatus as claimed in claim 17 wherein the flameless heater is located within a heater environment and wherein the sensed temperature is comprised of an ambient heater environment temperature.

20. The apparatus as claimed in claim 19 wherein the heat exchanger loop is further comprised of a supply section extending between the heat absorbing section and the heat transferring section and wherein the sensed temperature is comprised of a heat exchanger loop temperature within the supply section.

21. The apparatus as claimed in claim 20 wherein the controller is configured such that the heat exchanger loop temperature is an override sensed temperature.

22. The apparatus as claimed in claim 5 wherein the heat exchanger loop is further comprised of a reservoir for storing an amount of the heat exchanger fluid.

23. The apparatus as claimed in claim 22 wherein the heat exchanger loop is further comprised of a return section extending between the heat transferring section and the heat absorbing section and wherein the reservoir is located within the return section.

24. The apparatus as claimed in claim 23 wherein the pump is located within the return section between the reservoir and the heat absorbing section.

25. The apparatus as claimed in claim 4 wherein the heat sink is comprised of a wellhead component.

26. The apparatus as claimed in claim 4 wherein the heat sink is comprised of a hydrocarbon storage tank.

* * * * *